US005088299A

United States Patent [19]

Peterson

[11] Patent Number: 5,088,299

[45] Date of Patent: Feb. 18, 1992

[54] INDUSTRIAL LIQUID CIRCULATING AND COOLING MACHINE

[75] Inventor: Roger A. Peterson, Braham, Minn.

[73] Assignee: McLean Midwest Corporation, Brooklyn Park, Minn.

[21] Appl. No.: 501,099

[22] Filed: Mar. 29, 1990

[51] Int. Cl.[5] ..... F25D 19/00

[52] U.S. Cl. ..... 62/298; 62/434; 62/448; 220/4.28

[58] Field of Search ..... 62/59, 237, 298, 299, 62/77, 435, 448, 434, 326, 430; 220/682, 690, 4.28; 321/257.1, 214

[56] References Cited

U.S. PATENT DOCUMENTS

| | | | |
|---|---|---|---|
| 1,896,953 | 2/1933 | Hassell | 62/435 X |
| 2,169,605 | 8/1939 | Griese | 62/77 |
| 2,538,015 | 1/1951 | Kleist | 62/430 X |
| 2,538,016 | 1/1951 | Kleist | 62/430 X |
| 3,271,968 | 9/1966 | Karnath | 62/435 X |
| 3,410,107 | 11/1968 | Wallace et al. | 62/298 X |
| 3,655,087 | 4/1972 | Luisada | 220/4.28 |

*Primary Examiner*—Albert J. Makay
*Assistant Examiner*—John Sollecito
*Attorney, Agent, or Firm*—Henry C. Kovar

[57] ABSTRACT

An industrial liquid circulating and cooling machine for hydraulic fluids, lubricants, cutting oil, chemicals and the like has a chassis, an electro-mechanical refrigeration system with a compressor and condenser and evaporator, a I/O communication bulkhead for liquid and electrical flow, a single air filter, removable side panels held on by novel structure and locked by manual latches, a cover panel hinged and locked to the side panel by manual latches, and a heat exchanger having a novel non-pressurized liquid tank with a baffled tube and fin evaporator immersed in the liquid in the tank.

10 Claims, 4 Drawing Sheets

FIG.5
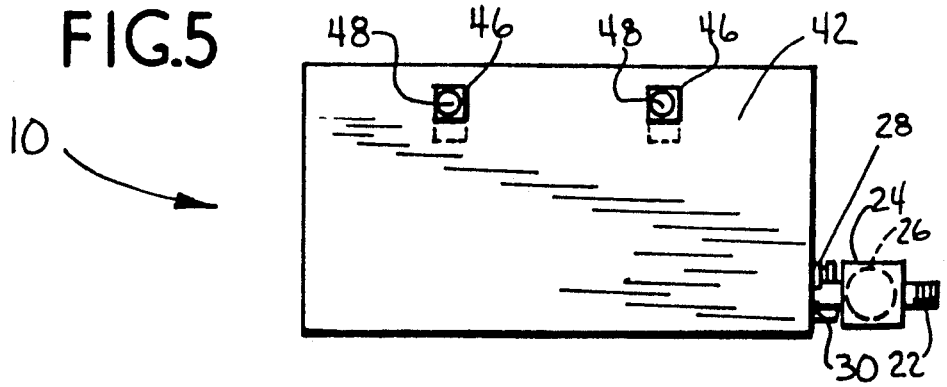
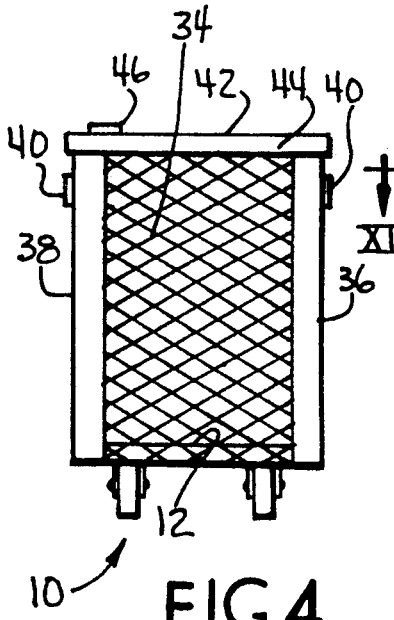
FIG.4
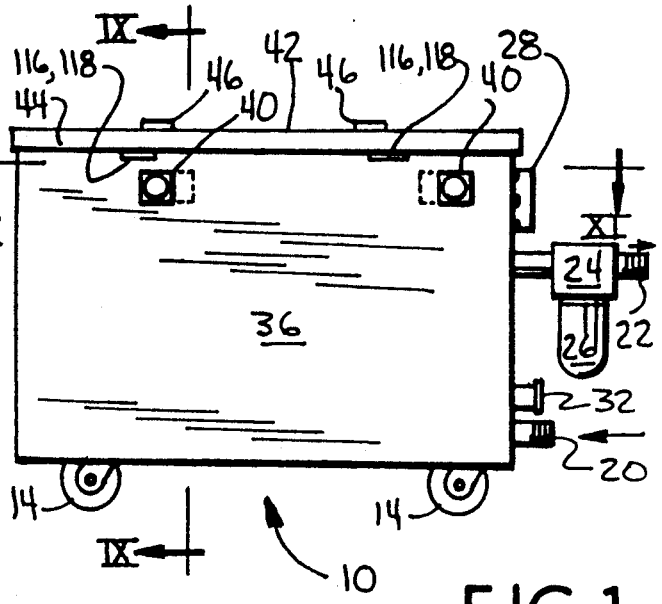
FIG.1
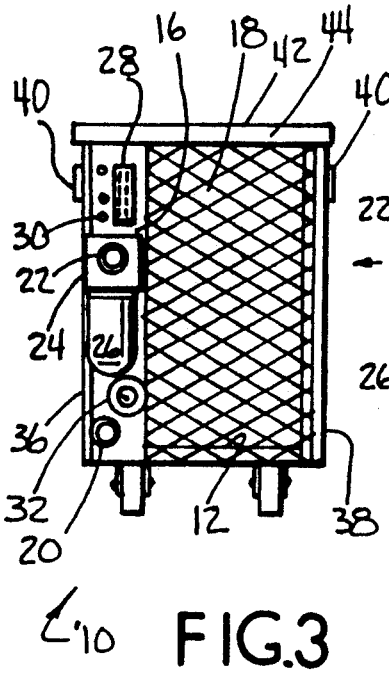
FIG.3
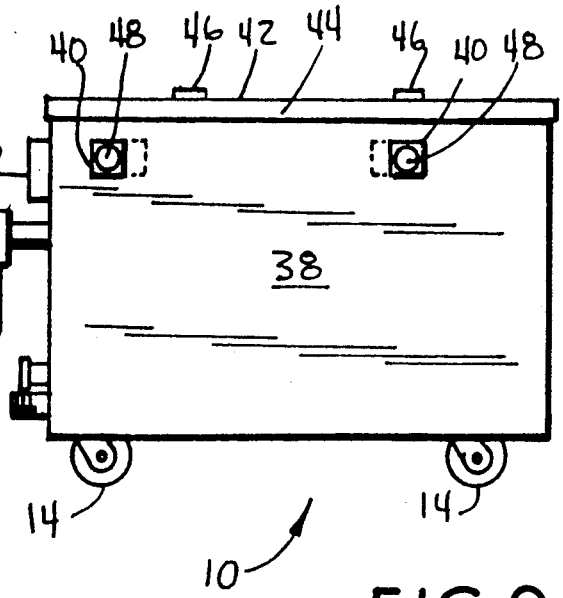
FIG.2

INDUSTRIAL LIQUID CIRCULATING AND COOLING MACHINE

BACKGROUND OF THE INVENTION

1. Field of the Invention

This invention pertains to a new and improved electro-mechanical apparatus for cooling hot liquids such as cutting fluids, hydraulic fluids, chemicals, coolants, and other industrial liquids.

2. The Prior Art

There have been prior electro-mechanical devices for cooling liquids such as the commonly used industrial fluids seen in machine tools, robotic devices, chemical processes and the like. These prior devices are characterized by an electro-mechanical refrigeration system being mounted on a chassis. Typically some type of exterior cabinet is provided.

These prior art devices typically are rather crude devices with exterior cabinetry having screws and/or bolts that require tools to remove and/or install, sharp edges and corners and protruding fastener heads to snag clothing and inflict cuts and scratches. Removal and re-installation of cabinetry has been difficult, fasteners have been lost, and many times cabinetry is not re-installed and is discarded. The prior art typically has had only a discrete, separate and remote liquid filter and no provision for determining conditions and effectiveness of the liquid filter. The prior art devices typically require dedicated wiring and connection of sensors and controls and quick connection/disconnection/removal-/installation has not been possible. The construction of the prior art requires trade union type people for operative connection/disconnection. The prior art devices typically filter only the air flow over the condensor coil and air flow over other componentry is not filtered. Filling and draining of the liquids into and from the prior art has been difficult. The prior art coolers are limited to low pressure application. In the prior art, the heat exchange elements, i.e. the evaporator coil, has not been easily separable from the work liquid circuit for manufacture, service, clean up, or replacement. There has been very poor and no effective sealing of the liquid circuit and leaks and spill-overs have been common. The prior art is probably best characterized as being barely sufficient for the purpose in the relatively dirty industrial environment of years past.

OBJECTS OF THE INVENTION

It is an object of this invention to provide a new and improved electro-mechanical liquid cooler.

It is an object of this invention to provide a liquid cooler with electro-mechanical refrigeration and new cabinetry structure for enhanced performance and suitability.

It is an object of this invention to provide a neat and clean liquid cooler.

It is an object of this invention to provide a liquid cooler providing improved access to essential components and improved serviceability.

SUMMARY OF THE INVENTION

An industrial liquid cooling machine has a chassis, an electro-mechanical refrigeration system, a heat exchanger including a refrigerant evaporator, first and second removable side panels, manual latches locking the side panels to the chassis, a removable cover panel, and manual latches locking the cover panel to one of the side panels.

An industrial liquid cooling machine has a chassis, an electro-mechanical refrigeration system, a liquid cooling tank and cover enclosing the evaporator, an electric motor and pump mounted on the tank cover, a liquid inlet and outlet, removable cover and side panels, and manual latches securing the panels to the chassis.

An industrial liquid cooling machine has a chassis, an electro-mechanical refrigeration system, an open topped cooling tank mounted to the chassis, a refrigeration evaporator in the tank, primary tubes and secondary fins in the evaporator, and a barrier structure to run the liquid through the fins and tubes in a serpentine pattern of flow.

These and other objects and advantages and inventive aspects will become manifest to those versed in the art upon review and appreciation of the teachings herein.

BRIEF DESCRIPTION OF THE DRAWINGS

FIG. 1 is a side elevational view of the preferred embodiment of an industrial liquid cooling machine according to the present invention;

FIG. 2 is an opposite side elevational view;

FIG. 3 is an end view;

FIG. 4 is an end view;

FIG. 5 is a top plan view;

DESCRIPTION OF THE PREFERRED EMBODIMENT

Figure 6:
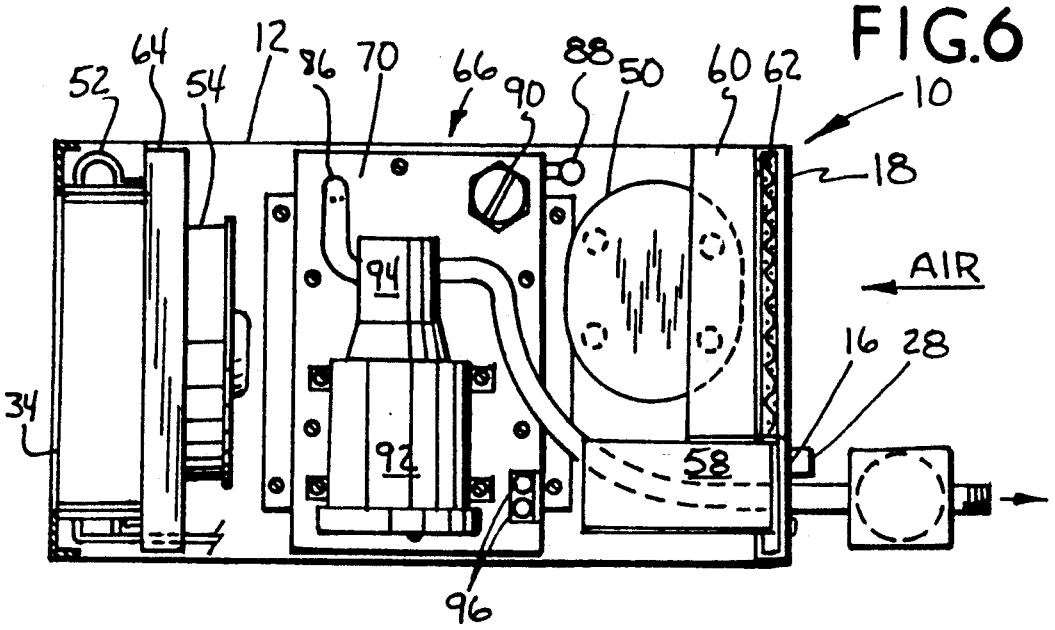
FIG. 6 is a top plan view with the cover and side panels removed.

An industrial liquid cooling machine is provided as shown in FIGS. 1-9 and 11 and as generally indicated by the numeral 10, for cooling of industrial work fluids such as hydraulic fluid, cutting oils, chemicals, lubricants and the like.

The machine 10 has a planar chassis 12 to which caster wheels 14 may be secured providing easy portability. On a first end of the machine 10 is a partial width I/O communications bulkhead 16 and a partial width air inlet screen 18. Extending through the bulkhead 16 are a hot work liquid inlet conduit 20, a relatively high pressure cooled work liquid outlet conduit 22 with a filter housing 24 and filter 26, a polarized multiple pin electrical connector 28 for both power and remote control leads, a plurality of process and alarm indicator lights 30, and a cooled liquid output pressure gauge 32. At a second end of the machine 10 is a full width hot air outlet covered and defined by a protective outlet screen 34. On each side of the machine 10 is a removable side panel 36, 38. Each side panel 36, 38 has a pair of generally flush manually operable latches 40. Atop of the machine 10 is a cover panel 42 having a full enclosing perimeter flange 44 and at least one and preferably two latches 46.

The preferred latches 40, 46 are identical and are available under the trademark SOUTHCO as part number A3-40-625-12. These latches 40, 46 are plastic, they snap in, are almost flush, have a finger detent 48, and are manually operable by the user's finger and without any tool whatsoever.

Figure 7:
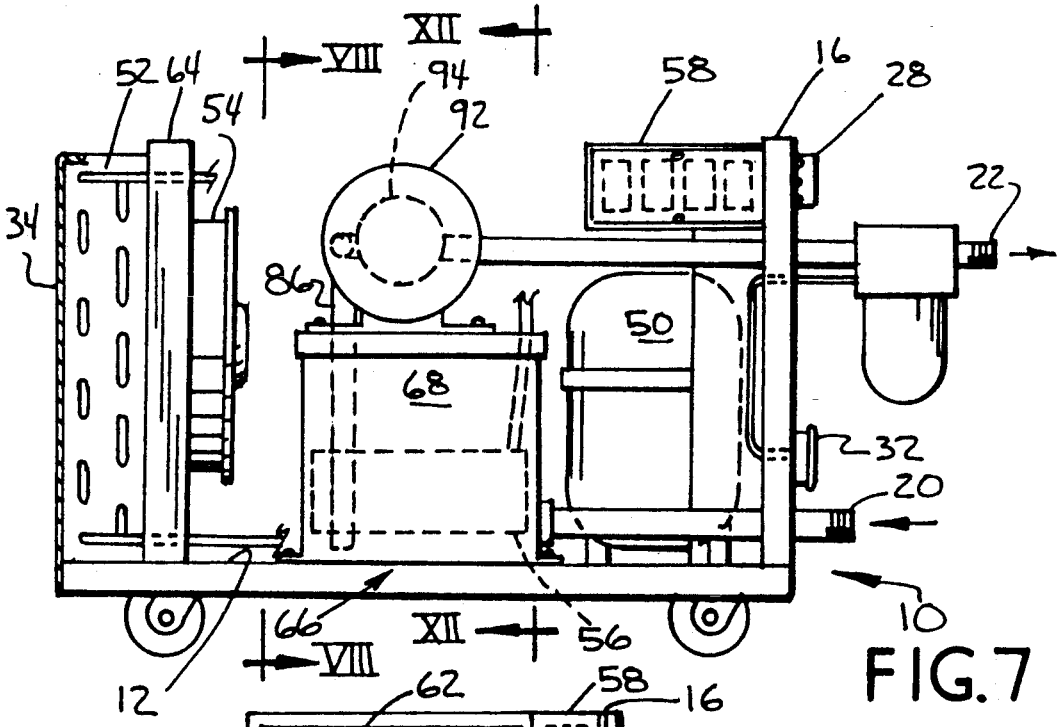
FIG. 7 is a side elevational view with the cover and side panels removed.
Figure 8:
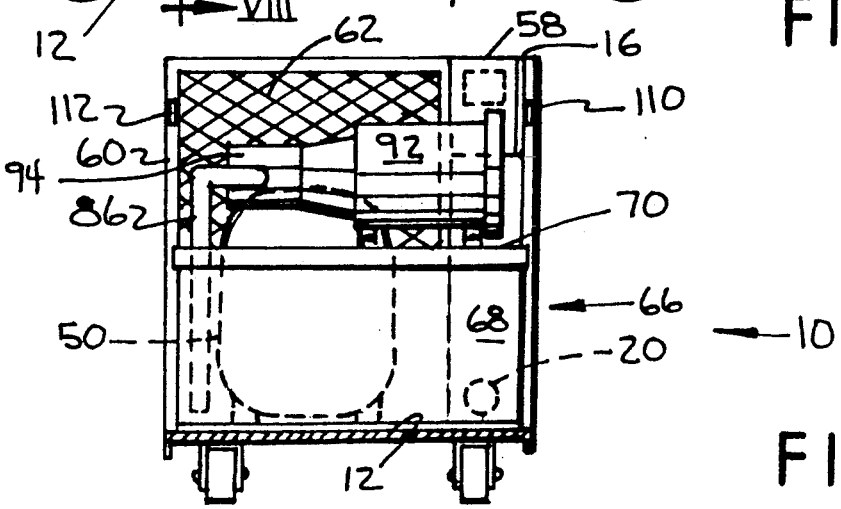
FIG. 8 is a sectional elevational view through lines VIII—VIII of FIG. 7.

FIGS. 6, 7 and 8 show the internal operative components of the machine 10 which include an operative electro-mechanical refrigeration system having a compressor 50, an air cooled condenser coil 52, a condenser fan 54 and an evaporator 56. The conventional refrigerant lines are not shown for purposes of clarity in the drawings. At the top of the bulkhead 16 is the electrical control box 58. A filter holder 60 is structurally connected to the chassis 12, the bulkhead 16, the inlet screen 18, and the control box 58. A single air filter 62 is provided just inward of the protective air inlet screen 18 for filtering all air drawn through the machine 10. A sheet metal condenser shroud 64 is secured to the condenser 52 and is between the condenser 52 and the fan 54.

Figure 12:
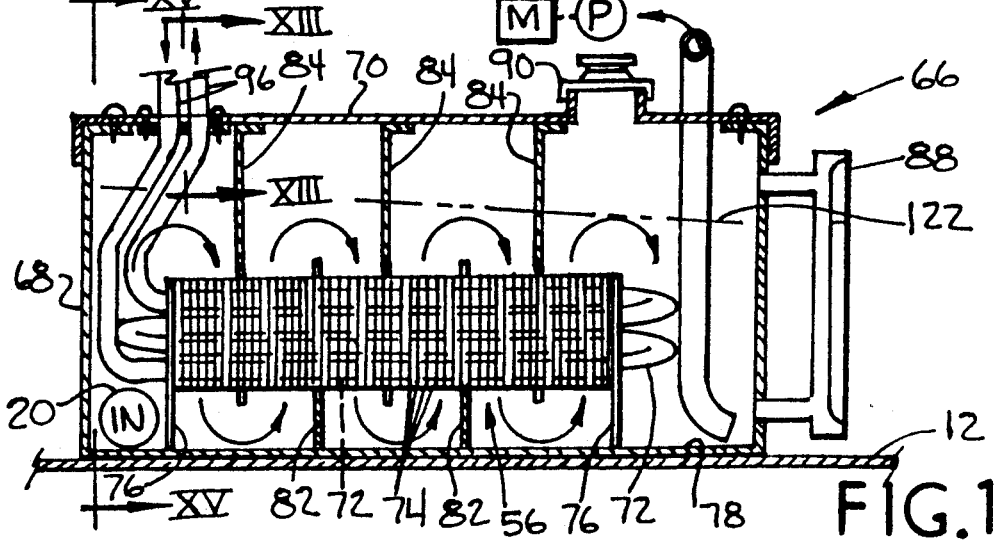
FIG. 12 is an elevational section view through lines XII—XII of FIG. 7.

A liquid heat exchanger 66 has an open topped liquid tank 68 of rectangular section on all three axis that is secured to the chassis 12. The tank 68 is operatively closed by a tank cover 70. Within the tank 68 is the complete cooling evaporator 56. The evaporator 56 has a plurality of primary heat exchange cooling tubes 72 and a plurality of appropriately spaced apart secondary heat exchange cooling fins 74. On each end of the evaporator 56 is a header 76. The evaporator 56 is spaced up and off of the tank bottom 78 by the headers 76 and by a pair of transverse coil supports 80. The evaporator 56 has its tubes 72 positioned generally horizontal and its fins 74 positioned upright as best shown in FIG. 12. Below the evaporator 56 are at least one and preferably a plurality of bottom barriers 82 and above the evaporator 56 are a plurality of top barriers 84. The barriers 82, 84 are spaced and staggered from each other as best shown in FIG. 12. The barriers 82, 84 may be integrated into the evaporator 56 as shown in dotted line in FIG. 12, and may also function as extended cooling fins.

At one end of the tank 68 is the non-pressurized liquid inlet 20 for hot incoming liquid and at the other end of the tank 68 is a liquid suction line 86 leading up and out of the tank 68. The tank 68, inlet 20, suction line 86, evaporator 56, headers 76, and barriers 82, 84 are structured and arranged to route the hot liquid in a multiple pass serpentine liquid flow path through the evaporator 56 as is shown in FIG. 12 so that the liquid makes multiple passes over the primary tubes 72 and passes over several fins 74. The tank 68 is also equipped with a work liquid level sight gauge 88 and a liquid fill aperture and cover 90. An electric motor 92 and high pressure liquid circulating and pressure pump 94 are mounted to the top of the tank cover 70, and the suction line 86 is connected to an inlet of the pump 94 and the liquid outlet conduit 22 is connected to an outlet of the pump 14. The work liquid output pressure gauge 32 is conected into the outlet conduit 22 downstream of the filter 26 and is capable of indicating condition of both the pump 94 and the filter 26 after filtration.

Figure 13:
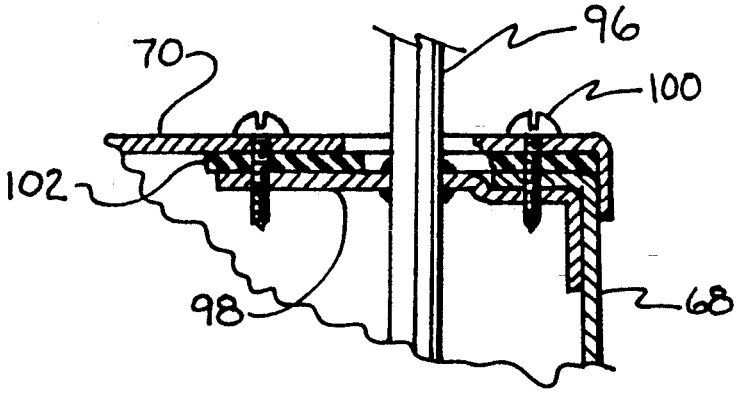
FIG. 13 is a detail elevational section view through lines XIII—XIII of FIG. 12.
Figure 14:
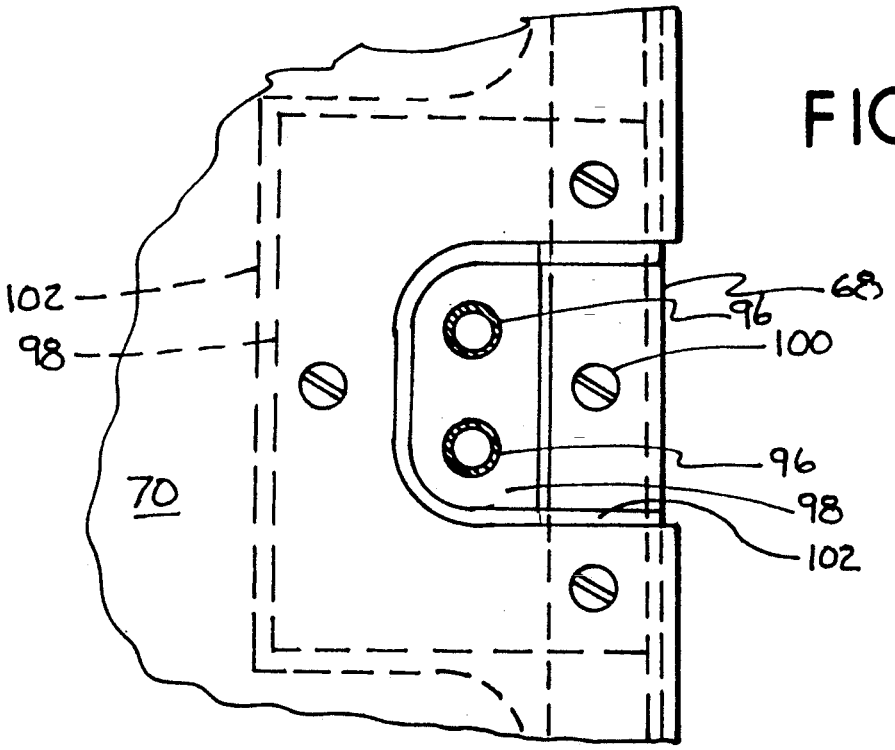
FIG. 14 is a top plan view of the structure detailed in FIG. 13.
Figure 15:
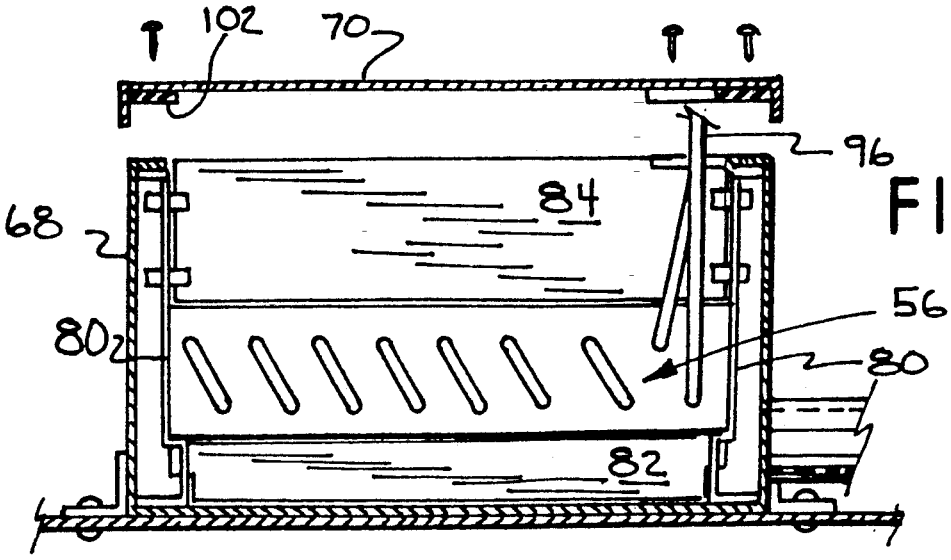
FIG. 15 is an elevational sectional view through lines XV—XV of FIG. 14.

The refrigerant tubes 96 leading to and from the evaporator 56 are soldered to a head plate 98 that is firstly fastened to the tank 68 by an appropriate fastener 100. The head plate 98 has an upper surface that is flush with the top of the tank 68 as shown in FIG. 13. A compliant gasket 102 is then placed around the entire top of the tank 68 and the head plate 98, and the tank cover 70 is securely fastened to the tank 68 and to the head plate 98 to provide a leak proof seal that is liquid tight and sufficient in view of the fact that the tank 68 is not pressurized.

The motor 92 and pump 94 can be removed and serviced and/or replaced without opening the tank 68. The condenser fan 54 is also easily removed and replaced without opening the liquid system. The fan 54 pulls a flow of relatively clean and cool filtered ambient air over the compressor 50, control box 58, pump 94 and motor 92, over itself, and then quietly discharges the hot air out of the condenser 52 through the full end area exhaust screen 34.

Figure 9:
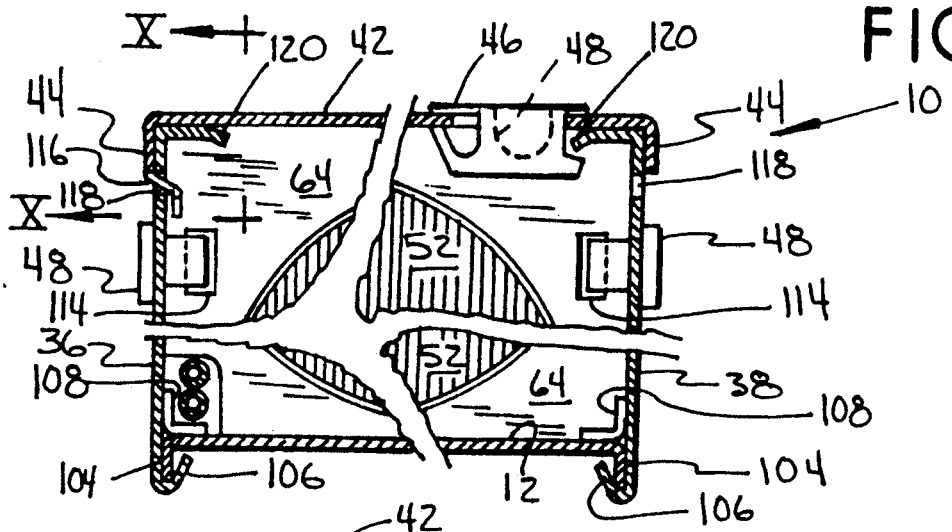
FIG. 9 is a sectional view to show the cabinetry corner and edge structure through lines IX—IX of FIG. 1.
Figure 10:
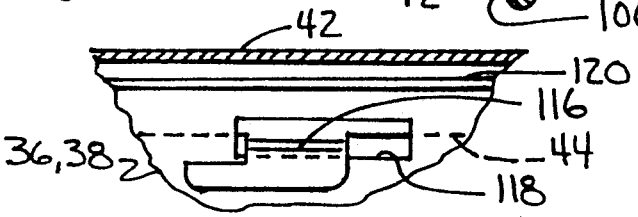
FIG. 10 is an elevational view from lines X—X of FIG. 9.
Figure 11:
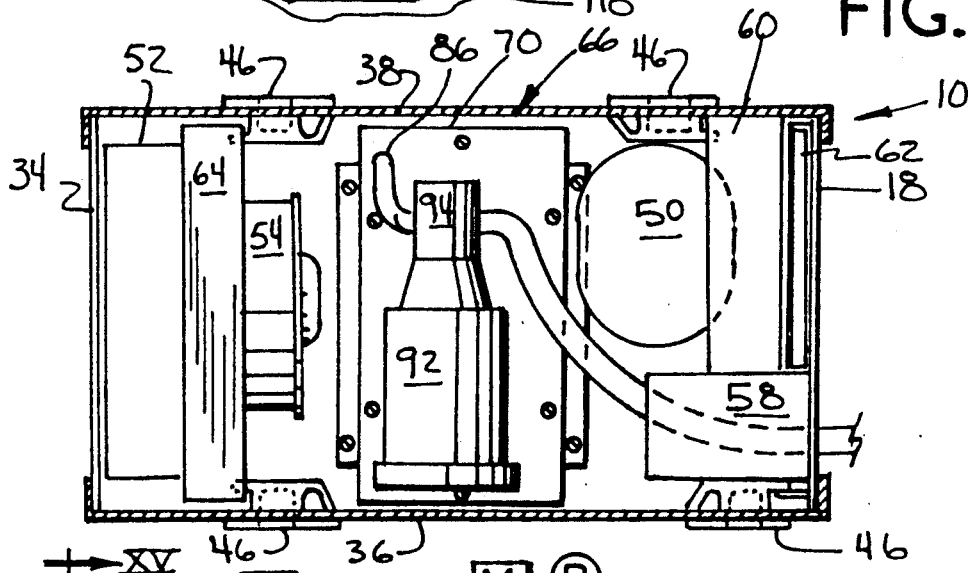
FIG. 11 is a top plan sectional view through lines XI—XI of FIG. 1.

FIGS. 9, 10 and 11 best illustrate the structure and operation of the removable panels 36, 38, 42 and the latches 40, 46. The chassis 12 has a pair of down turned side flanges 104. Each side panel 36, 38 has a full length open hem flange 106 that goes under and encloses the respective chassis flange 104. Each side panel 36, 38 then has a vertical support clip 108 that rides upon the top of the chassis 12 to hold the side panels 36, 38 up. The side panel latches 40 are adjacent the top edges of the side panels 36, 38 and are arranged to engage a single latch aperture 110 in the bulkhead 16, a single latch aperture 112 in the filter holder 60, and a pair of latch apertures 114 in the condenser shroud 64. Any liquid running off the chassis 12 will be captured in the hem flange 106, and the hem flange 106 presents rounded edges by which the machine 10 may be easily picked up without gloves. On one side of the cover 42 is a pair of longitudinally spaced apart hinge tongues 116 which extend through complementary hinge mouths 118 in at least one and preferably both side panels 36, 38. The tongues 116 are structured as shown in FIG. 10 to slip fit through the mouths 118 and to longitudinally slide and lock/unlock the cover panel 42 in a hinged relationhip to either of the side panels 36, 38. The cover latch 46 is properly positioned to lock under the top flange 120 of either side panel 36, 38 to lock the hinged cover panel 42 down. The cover panel 42 will hinge to either side panel 36, 38 and is thus reversible at the end users discretion.

The advantages of the machine 10 are many. It has extremely high thermal capacity and can integrally produce high work liquid output pressures and indicate its output pressure. All side and cover panels 36, 38, 42 come off easily without tools for fluid fill, inspection and cleaning, and re-install quickly and easily without tools. The machine 10 is easily cleaned with conventional cleaning equipment. The cabinet is neat and clean and devoid of snags and sharp edges. The air filter 62 is easily changed. Air over all moving components is filtered and cool. A single connector 28 for electrical power and control signals provides fast connection. The tank 68 is easy to drain and empty. The normal working liquid level 122 within the tank 68 is shown in FIG. 12.

Many other advantages, features and additional objects of the present invention will become manifest to those versed in the art upon making reference to the detailed description and accompanying drawings in which the preferred embodiment incorporating the principles of the present invention is set forth and shown by way of illustrative example.

Although other advantages may be found and realized and various modifications may be suggested by those versed in the art, be it understood that I embody, within the scope of the patent warranted hereon, all such embodiments as reasonably and properly come within the scope of my contribution to the art.

I claim as my invention:

1. An industrial liquid cooling machine comprising a) a chassis;

b) an operative electro-mechanical refrigeration system mounted on said chassis and having a compressor, a condenser and an evaporator;

c) a liquid heat exchanger mounted to said chassis, said evaporator being an operative part of said heat exchanger;

d) first and second removable side panels;

e) manually operable latches locking said side panels to said chassis;

f) a removable cover panel over said chassis and said side panels;

g) at least one manually operable latch locking said cover panel to one of said side panels;

h) a base plate in said chassis, said base plate having downward extending edge flanges;

i) U-shaped lower open hem flanges on said side panels, said hem flanges being extended under said edge flanges;

j) means above said hem flanges for vertical support of said side panels upon said chassis; and in which.

k) said side panel latches are all adjacent a top edge of said side panels.

2. The liquid cooling machine of claim 1, in which said hem flanges are full length on each side panel.

3. The liquid cooling machine of claim 1, including a hinge mechanism between said cover panel and one of said side panels.

4. The liquid cooling machine of claim 3, including means in said hinge for separating said cover panel from said side panels, when said cover is open and while said side panels remain secured to said chassis.

5. The liquid cooling machine of claim 3, in which said hinge mechanism includes means for hinging said cover to either of said side panels.

6. An industrial liquid cooling machine comprising a) a chassis;

b) an electro-mechanical refrigerator system having a compressor, an air cooled condenser, an evaporator and a condenser fan, said compressor and said condenser being mounted to said chassis; said condenser fan being positioned to draw a flow of ambient cooling air over the motor and the pump.

c) a liquid cooling tank secured to said chassis, said evaporator being inside of said cooling tank;

d) a tank cover atop of and fastened to said tank;

e) seal means liquid tightly sealing said cover to said tank;

f) an electric pump motor and liquid pressure pump mounted on top of said tank cover;

g) a liquid inlet conduit extending into the tank from outside of the chassis;

h) a liquid suction conduit extending upward from inside the tank to the pump;

i) a pressurized liquid outlet conduit extending from the pump to outside of the cabinet;

j) a removable cover panel and at least one removable side panel enclosing the refrigeration system, the tank, and the motor and pump;

k) manually operable latches securing said panels to said chassis;

l) a communication bulkhead on one end of the chassis with said bulkhead having a liquid inlet and a liquid outlet and electrical power and control connectors;

m) an air filter alongside said bulkhead; and n) a full width hot air outlet out of a second end of the chassis.

7. The machine of claim 6, including a filter holder opposite from the bulkhead, a condenser shroud between the condenser and the condenser fan, a pair of side panels, latching means in said bulkhead for one side panel to latch to, latching means in said filter holder for one side panel to latch to, and latching means in said condenser shroud for both side panels to latch to.

8. The machine of claim 7, including a detachable hinge between one side of said cover panel and either of said side panels.

9. An industrial liquid cooling machine comprising a) a chassis;

b) an operative electro-mechanical refrigeration system mounted on said chassis and having a compressor, a condenser and an evaporator;

c) a liquid heat exchanger mounted to said chassis, said evaporator being an operative part of said heat exchanger;

d) first and second removable side panels;

e) manually operable latches locking said side panels to said chassis;

f) a removable cover panel over said chassis and said side panels;

g) at least one manually operable latch locking said cover panel to one of said side panels; and h) a single communication bulkhead on one end of the chassis and in between the removable side panels, said communication bulkhead having means for admitting in and for discharging work liquid to be cooled, electrical power and control connectors, and means for indicating output pressure of cooled and filtered work fluid.

10. An industrial liquid cooling machine comprising a) a chassis;

b) an operative electro-mechanical refrigeration system mounted on said chassis and having a compressor, a condenser and an evaporator;

c) a liquid heat exchanger mounted to said chassis, said evaporator being an operative part of said heat exchanger;

d) first and second removable side panels;

e) manually operable latches locking said side panels to said chassis;

f) a removable cover panel over said chassis and said side panels;

g) at least one manually operable latch locking said cover panel to one of said side panels; and h) a condenser shroud secured to said chassis, a pair of latch receptacles in said shroud, and in which at least one said side panel latch on each side panel is operatively latched to said shroud.

* * * * *